US006050548A

United States Patent [19]

Leger

[11] Patent Number: 6,050,548

[45] Date of Patent: Apr. 18, 2000

[54] COLLAPSIBLE LIFTING ASSEMBLY

[76] Inventor: Harry P. Leger, 3682 LA Hwy., 78, Livionia, La. 70755

[21] Appl. No.: 09/285,217

[22] Filed: Apr. 1, 1999

[51] Int. Cl.[7] ..... B66D 3/00

[52] U.S. Cl. ..... 254/326; 254/4 R; 254/335

[58] Field of Search ..... 254/325, 326, 254/334, 335, 4 R, 8 R, 8 B

[56] References Cited

U.S. PATENT DOCUMENTS

| | | | |
|---|---|---|---|
| 1,422,459 | 7/1922 | Manley | 254/326 |
| 1,887,965 | 11/1932 | Stoner | 254/326 |
| 1,974,463 | 9/1934 | Kintzley | 254/325 |
| 2,892,555 | 6/1959 | Hooker | 254/326 |
| 3,450,386 | 6/1969 | Eliel | 254/326 |
| 3,794,296 | 2/1974 | Hasstedt | 254/335 |
| 4,144,973 | 3/1979 | Reale | 212/8 R |
| 4,497,469 | 2/1985 | Barnhouse | 254/8 B |
| 4,669,703 | 6/1987 | Hawkins et al. | 254/8 B |
| 4,899,986 | 2/1990 | Tweedy | 254/8 B |
| 4,902,191 | 2/1990 | Cumbest et al. | 414/729 |
| 5,090,667 | 2/1992 | Harrell | 254/326 |
| 5,195,726 | 3/1993 | Kaner | 254/325 |
| 5,261,640 | 11/1993 | Yuan | 254/8 B |
| 5,918,861 | 7/1999 | Parker | 254/326 |

*Primary Examiner*—Katherine A. Matecki
*Attorney, Agent, or Firm*—Joseph N. Breaux

[57] ABSTRACT

An assembly for lifting items and work pieces that is collapsible for storage and that includes that includes a collapsible lifting structure and a detachable wheel assembly. The collapsible lifting structure includes a forked base member, a hollow vertical support tube, a derrick structure, a pulley assembly suspended, a winch assembly, and a cable having an end attached to a connecting hook. The vertical shaft is securable to the hollow vertical support tube in a first orientation for use with the extension arm positioned between the two legs of the forked base member and a second orientation for storage with the extension arm offset ninety degrees from its orientation in the first orientation.

1 Claim, 3 Drawing Sheets

COLLAPSIBLE LIFTING ASSEMBLY

TECHNICAL FIELD

The present invention relates to hoists and the like and more particularly to a lifting assembly that includes a collapsible lifting structure and a detachable wheel assembly.

It is often desirable to have a device for lifting and holding heavy items or work pieces that can be configured for easy storage.

BRIEF SUMMARY OF THE INVENTION

It is thus an object of the invention to provide a lifting assembly that is collapsible into a storage configuration to facilitate storage of the lifting assembly when not needed.

It is a further object of the invention to provide a lifting assembly that includes a collapsible lifting structure and a detachable wheel assembly; the collapsible lifting structure including a forked base member including two legs attached at a mid-portion having two spaced, upwardly projecting parallel attachment plates each provided with securing pin apertures, a hollow vertical support tube sized to fit between the two spaced, upwardly projecting parallel attachment plates and having a two securing apertures, a pair of leg securing pins positionable through the two securing apertures, both securing pin apertures being alignable with the two securing pin apertures of the attachment plates when the hollow vertical support tube is oriented perpendicular to the legs and one securing pin aperture being alignable with one of the two securing pin apertures of the attachment plates when the hollow vertical support tube is oriented parallel to the legs, a derrick structure including a vertical shaft slidably positionable within the hollow vertical support tube and securable with respect thereto with a shaft securing pin and an extension arm extending from a top end of the vertical shaft at an obtuse angle, a pulley assembly suspended from a far end of the extension arm, a height adjustable ratchet winch assembly adjustably attached to the vertical shaft and including a vertical shaft attachment mechanism, a rotatably mounted cable spool having a spool handle, and a cable having a first end attached to the cable spool and a second end threaded through the pulley assembly and attached to a connecting hook; the detachable wheel assembly including two wheels attached to a U-shaped bracket having two spaced wheel securing plates with wheel connecting apertures formed therethrough and spaced apart sufficiently such that the two spaced, upwardly projecting parallel attachment plates of the forked leg member fit therebetween and are securable thereto with the leg securing pins; the vertical shaft being securable to the hollow vertical support tube in a first orientation for use with the extension arm positioned between the two legs of the forked base member and a second orientation for storage with the extension arm offset ninety degrees from its orientation in the first orientation.

BRIEF DESCRIPTION OF THE DRAWINGS

For a further understanding of the nature and objects of the present invention, reference should be made to the following detailed description, taken in conjunction with the accompanying drawings, in which like elements are given the same or analogous reference numbers and wherein.

DETAILED DESCRIPTION OF THE INVENTION

Figure 1:
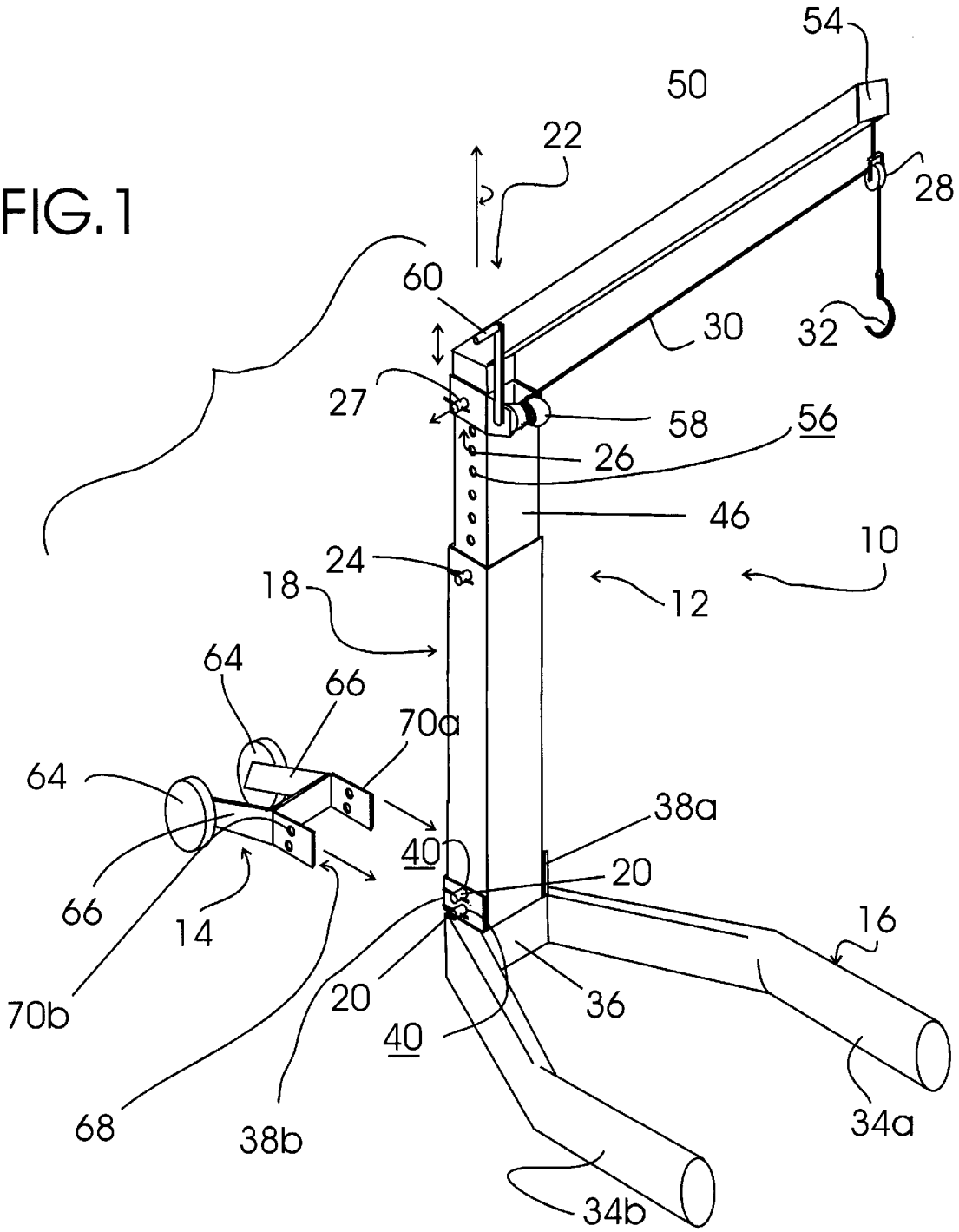
FIG. 1 is a perspective view of an exemplary embodiment of the lifting assembly of the present invention showing the collapsible lifting structure and the detachable wheel assembly.

FIG. 1 shows an exemplary embodiment of the lifting assembly of the present invention generally designated 10. Lifting assembly 10 includes a collapsible lifting structure, generally designated 12, and a detachable wheel assembly, generally designated 14.

Collapsible lifting structure 12 includes a forked base member, generally designated 16; a hollow vertical support tube, generally designated 18; a pair of leg securing pins 20; a derrick structure, generally designated 22; a shaft securing pin 24; a ratchet winch assembly, generally designated 26; a winch assembly securing pin 27; a pulley assembly 28; a cable 30; and a connecting hook 32.

Forked base member 16 has two spaced legs 34*a*,34*b* attached at a mid-portion 36 having two spaced, upwardly projecting parallel attachment plates 38*a*,38*b* each provided with two securing pin apertures 40. Hollow vertical support tube 18 is sized to fit between the two spaced, upwardly projecting parallel attachment plates 38*a*,38*b* and has two securing apertures formed therethrough. Both securing pin apertures are alignable with the two securing pin apertures 40 of the attachment plates 38*a*,38*b* when the hollow vertical support tube 18 is oriented perpendicular to legs 34*a*,34*b* and one securing pin aperture is alignable with one of two securing pin apertures 40 of the attachment plates 38*a*,38*b* when the hollow vertical support tube 18 is oriented parallel to legs 34*a*,34*b*.

Derrick structure 22 includes a vertical shaft 46 slidably positionable within hollow vertical support tube 18 and securable with respect thereto with shaft securing pin 24. An extension arm 50 extends from a top end of vertical shaft 46 at an obtuse angle. Pulley assembly 28 is suspended from a far end 54 of extension arm 50. Height adjustable ratchet, winch assembly 26 is adjustably attached to vertical shaft 46 with winch assembly securing pin 27 and spaced apertures 56 formed along the length of vertical shaft 46. Ratchet winch assembly 26 is a conventional boat trailer type ratchet winch with a rotatably mounted cable spool 58 that is rotated by a spool handle 60.

Cable 30 is a length of steel wire cable having a first end attached to cable spool 58 and a second end threaded through pulley assembly 28 and attached to connecting hook 32. Items and work pieces can thus be raised and/or lowered by operation of winch assembly 26 and the use of connecting hook 32.

Detachable wheel assembly 14 includes two wheels 64 rotatably attached to extension legs 66 attached to a U-shaped bracket, generally designated 68. U-shaped bracket 68 has two spaced wheel securing plates 70*a*,70*b* with wheel connecting apertures formed therethrough and spaced apart sufficiently such that the two spaced, upwardly projecting parallel attachment plates 38*a*,38*b* of forked leg member 16 fit therebetween and, referring now to FIG. 2, are securable thereto with leg securing pins 20.

Figure 2:
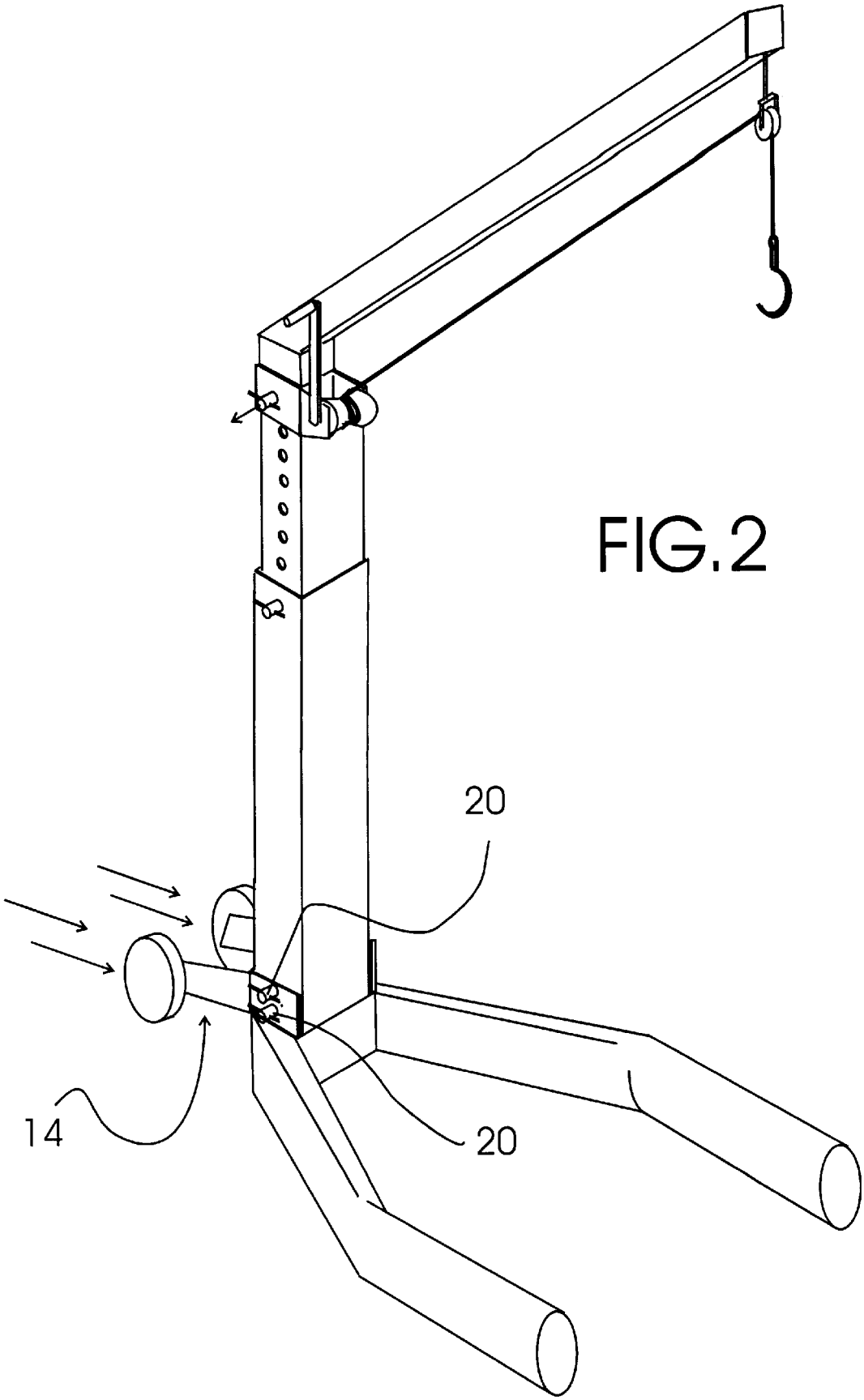
FIG. 2 is a perspective view of the lifting assembly of FIG. 1 with the detachable wheel assembly secured to the collapsible lifting structure.
Figure 3:
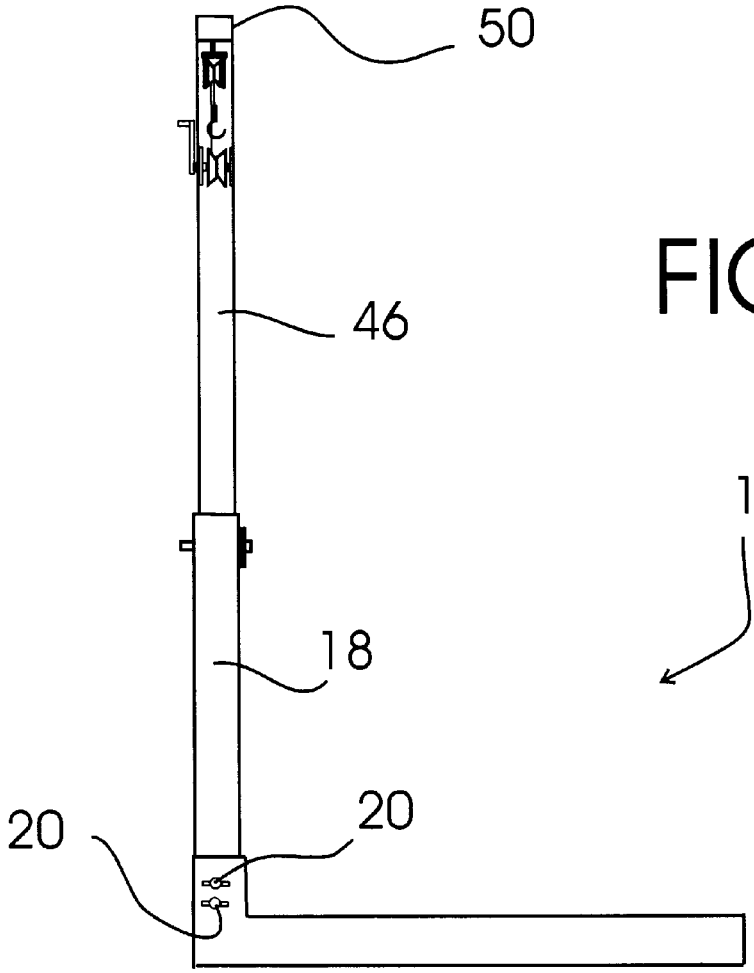
FIG. 3 is a side plan view of the lifting assembly of FIG. 1 with the vertical shaft secured to the hollow vertical support tube in the second orientation for storage.
Figure 4:
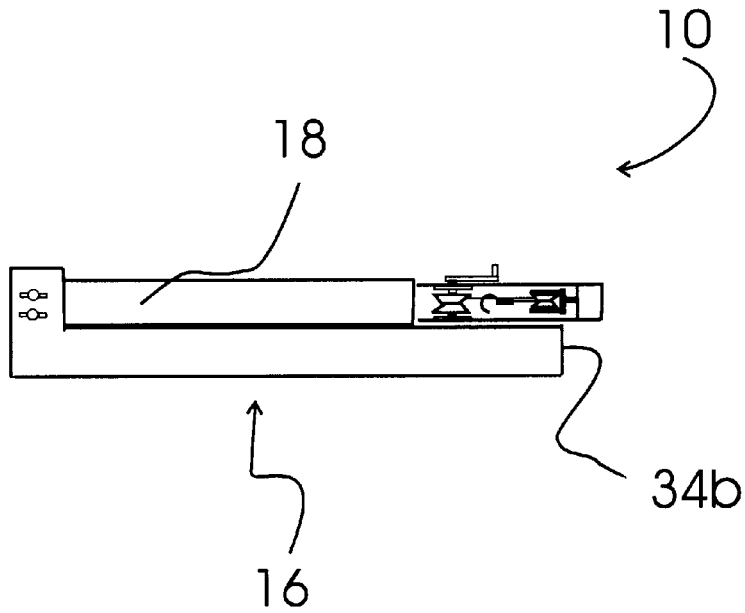
FIG. 4 is a side plan view of the lifting assembly of FIG. 1 in the collapsed storage configuration with the vertical shaft secured to the hollow vertical support tube in the second orientation and the hollow vertical support tube oriented parallel to the legs and secured to the parallel attachment plates of the forked base member.

Referring to FIG. 3, lifting assembly 10 is collapsed for storage by removing shaft securing pin 24, pulling vertical shaft 46 out of hollow vertical support tube 18, and rotating extension arm 50 ninety degrees with respect to its use orientation shown in FIGS. 1 and 2 prior to reinserting vertical shaft 46 back into hollow vertical tube 18. Leg securing pins 20 are then removed and, referring now to FIG. 4, hollow vertical support tube 18 rotated ninety degrees downward into a parallel orientation with the legs of forked base member 16. Lifting assembly 10 is now in the collapsed storage configuration.

It is noted that the embodiment of the lifting assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed In accordance with the descriptive requirements of the law, it is to be understood that the details herein are to be interpreted as illustrative and not in a limiting sense.

What is claimed is:

1. A lifting assembly comprising:

a collapsible lifting structure; and a detachable wheel assembly;

said collapsible lifting structure including a forked base member including two legs attached at a mid-portion having two spaced, upwardly projecting parallel attachment plates each provided with securing pin apertures, a hollow vertical support tube between said two spaced, upwardly projecting parallel attachment plates and having two pin securing apertures, a pair of leg securing pins positionable through said two securing apertures, both securing pin apertures being alignable with said two securing pin apertures of said attachment plates when said hollow vertical support tube is oriented perpendicular to said legs and one securing pin aperture being alignable with one of said two securing pin apertures of said attachment plates when said hollow vertical support tube is oriented parallel to said legs, a derrick structure including a vertical shaft slidably positioned within said hollow vertical support tube and securable with respect thereto with a shaft securing pin and an extension arm extending from a top end of said vertical shaft at an obtuse angle, a pulley assembly suspended from a far end of said extension arm, a height adjustable ratchet winch assembly adjustably attached to said vertical shaft and including a vertical shaft attachment mechanism, a rotatably mounted cable spool having a spool handle, and a cable having a first end attached to said cable spool and a second end threaded through said pulley assembly and attached to a connecting hook;

said detachable wheel assembly including two wheels attached to a U-shaped bracket having two spaced wheel securing plates with wheel connecting apertures formed therethrough and spaced apart sufficiently such that said two spaced, upwardly projecting parallel attachment plates of said forked base member fit therebetween and are secured thereto with said leg securing pins;

said vertical shaft being secured to said hollow vertical support tube in a first orientation for use with said extension arm positioned above and between said two legs of said forked base member and a second orientation for storage with said extension arm offset ninety degrees from its orientation in said first orientation.

* * * * *